US009527202B2

(12) United States Patent
Esenwein et al.

(10) Patent No.: US 9,527,202 B2
(45) Date of Patent: Dec. 27, 2016

(54) HAND-OPERATED MACHINE TOOL DEVICE

(75) Inventors: Florian Esenwein, Leinfelden-Echterdingen (DE); Manfred Lutz, Filderstadt (DE); Achim Trick, Sielmingen (DE); Thomas Schomisch, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 917 days.

(21) Appl. No.: 13/819,189

(22) PCT Filed: Jul. 28, 2011

(86) PCT No.: PCT/EP2011/063001

§ 371 (c)(1),
(2), (4) Date: May 13, 2013

(87) PCT Pub. No.: WO2012/025328

PCT Pub. Date: Mar. 1, 2012

(65) Prior Publication Data

US 2013/0220657 A1 Aug. 29, 2013

(30) Foreign Application Priority Data

Aug. 26, 2010 (DE) ..... 10 2010 039 794

(51) Int. Cl.
*B25F 5/02* (2006.01)
*B25F 1/04* (2006.01)
(Continued)

(52) U.S. Cl.
CPC ..... *B25F 5/02* (2013.01); *B24B 23/028* (2013.01)

(58) Field of Classification Search
CPC ..... B25F 5/02; B25F 5/00; B25F 5/026; B25F 1/04; B24B 23/028
(Continued)

(56) References Cited

U.S. PATENT DOCUMENTS 3,579,002 A * 5/1971 Wickham ..... H01H 9/063 200/522
6,023,848 A 2/2000 Dassoulas et al.
(Continued)

FOREIGN PATENT DOCUMENTS

CN 1169901 A 1/1998
CN 1688418 A 10/2005
(Continued)

OTHER PUBLICATIONS

International Search Report corresponding to PCT Application No. PCT/EP2011/063001, mailed Feb. 22, 2012 (German and English language document) (7 pages).

*Primary Examiner* — Michelle Lopez
(74) *Attorney, Agent, or Firm* — Maginot, Moore & Beck LLP

(57) ABSTRACT

A hand-operated machine tool device, in particular for an angle grinder, includes a housing region and at least one operating element. The housing region is at least substantially rod-shaped and is configured to be used as a main gripping element. The at least one operating element extends in the housing region in a main extension direction of the housing region. The hand-operated machine tool device also has a least one mounting which supports at least one operating face of the at least one operating element such that the at least one operating element is configured to pivot about at least one axis aligned at least substantially parallel to the main extension direction.

13 Claims, 10 Drawing Sheets

(51) Int. Cl.
*B25F 5/00* (2006.01)
*B24B 23/02* (2006.01)

(58) Field of Classification Search
USPC ..... 173/170, 217
See application file for complete search history.

(56) References Cited

U.S. PATENT DOCUMENTS

| | | | | |
|---|---|---|---|---|
| 6,602,122 | B1 * | 8/2003 | Rudolf | B24B 23/005 451/344 |
| 2006/0267548 | A1 | 11/2006 | Uehlein-Proctor et al. | |

FOREIGN PATENT DOCUMENTS

| | | | | |
|---|---|---|---|---|
| DE | 90 04 826 | U1 | 8/1990 | |
| DE | EP 1016505 | A2 * | 7/2000 | B23D 45/16 |
| GB | 2 462 938 | A | 3/2010 | |
| WO | 2010/026963 | A1 | 3/2010 | |

* cited by examiner

HAND-OPERATED MACHINE TOOL DEVICE

This application is a 35 U.S.C. §371 National Stage Application of PCT/EP2011/063001, filed on Jul. 28, 2011, which claims the benefit of priority to Serial No. DE 10 2010 039 794.6, filed on Aug. 26, 2010 in Germany, the disclosures of which are incorporated herein by reference in their entirety.

BACKGROUND

The disclosure is based on a hand power tool according to the description below.

There has already been proposed a hand power-tool device, in particular for an angle grinder, having an at least substantially rod-shaped housing region that, during operation, serves as a main handle element, and having at least one operating element, which extends, on the housing region, along a direction of main extent of the housing region.

SUMMARY

The disclosure is based on a hand power-tool device, in particular for an angle grinder, having an at least substantially rod-shaped housing region that, during operation, serves as a main handle element, and having at least one operating element, which extends, on the housing region, along a direction of main extent of the housing region.

It is proposed that the hand power-tool device has at least one bearing, by which at least one operating face of the operating element is carried so as to be swivelable about at least one axis aligned at least substantially parallelwise in relation to the direction of main extent. In particular, a "rod-shaped housing region" is to be understood to mean a region of a housing of a hand power tool having a longitudinal extent that is at least twice as long, advantageously at least three times as long, particularly advantageously at least four times as long, as a maximum transverse extent. Preferably, the rod-shaped housing region has an at least partially rounded outer face, particularly preferably an at least substantially cylindrical outer face. Preferably, the rod-shaped housing region has, in particular, a substantially round outer cross section, on at least a plane aligned perpendicularly in relation to the direction of main extent, advantageously on a greater part of a total length. Alternatively or additionally, the housing region could have one or more outer cross sections, considered appropriate by persons skilled in the art, for example polygonal and/or elliptical outer cross sections. Preferably, the outer cross section is less than 15 cm, particularly preferably less than 10 cm. In particular, one or more housing elements can constitute the rod-shaped housing region. Furthermore, the hand power-tool device could have a plurality of rod-shaped housing regions. Preferably, the rod-shaped housing region encloses at least one function element of a hand power tool, and in particular it encloses a function element of a drive train of the hand power tool such as, for example, a motor, a transmission and/or an electronics unit. The expression "during operation" is to be understood to mean, in particular, during a work operation conducted by an operator. In particular, the term "main handle element" is to be understood to mean, in particular, an element provided to be gripped by the operator, in particular during a work operation in a confined space. "Provided" is to be understood, in particular, as specially configured. In particular, an "operating element" is to be understood to mean an element by means of which the operator influences the state of the hand power tool, advantageously a state of a motor of the hand power tool, during a work operation. Preferably, the operator influences a rotational speed of an insert tool by means of the operating element. The expression "along the housing region" is to be understood to mean, in particular, that the operating element has at least one partial face adjacent to and, in particular, separated by less than 5 mm from, the housing region. In particular, a "direction of main extent" is to be understood to mean a direction in which an element parallel to an outer contour has a maximum extent. Preferably, the housing region and/or, in particular, the operating face has a plane of symmetry aligned parallelwise in relation to the direction of main extent, over a region along the direction of main extent. Alternatively, the housing region and/or the operating face can be realized asymmetrically. A "bearing" is to be understood to be, in particular, a unit provided to exert upon the operating element a bearing force that counteracts a motion other than a swiveling motion. In particular, an "operating face" is to be understood to mean a face of the operating element upon which an operator exerts a force during an actuation. The expression "substantially parallelwise" is to be understood to mean, in particular, that an angle between the direction of main extent of the housing region and the axis is less than 30 degrees, particularly preferably less than 10 degrees. In particular, the expression "carried so as to be swivelable" is to be understood to mean that the bearing fastens the operating element such that it is rotatable about an axis, over an angular range. The configuration of the hand power-tool device according to the disclosure makes it possible to achieve comfortable operation, in particular in combination with a dead-man circuit. In particular, an actuating force and an actuating stroke of the operating element are substantially constant at differing locations along the direction of main extent of the operating element. Owing to the swivelable mounting, there is little susceptibility to jamming, this being particularly advantageous, in particular in comparison with an operating element that is moved translationally. A "dead-man circuit" is to be understood to mean, in particular, a circuit that automatically deactivates the hand tool in the case of a termination of an intended activation of the hand power tool, for example in the case of unconsciousness, and/or in the case of intentional release.

In a further configuration, it is proposed that the operating element has a direction of main extent aligned at least substantially parallelwise in relation to the direction of main extent of the housing region, whereby, through simple configuration, particularly comfortable and safe operation can be achieved, in particular substantially irrespective of an operator hand position along the main extent.

Furthermore, it is proposed that the operating element extends over at least a greater part of a total length of the rod-shaped housing region, whereby very particularly safe and comfortable operation is made possible through simple configuration. A "total length" is to be understood to mean, in particular, an extent along the direction of main extent. In particular, the expression "extend over at least a greater part of a total length" is to be understood to mean that planes aligned perpendicularly in relation to the direction of main extent intersect the housing region and the operating element on at least 50%, preferably at least 75% of the total length of the housing region.

Further, it is proposed that the operating face is realized in a convexly curved manner, enabling an operator to comfortably and reliably operate the operating means from differing sides. In particular, the operating element is equally suited for operation by left-handed and right-handed operators. Preferably, the operating face is convexly curved in at least one plane aligned perpendicularly in relation to the direction of main extent of the operating element.

Advantageously, the operating face in this plane is convexly curved on a segment of at least 10 mm, advantageously 20 mm. Preferably, the convexly curved operating face has a radius of greater than 20 mm, particularly preferably greater than 40 mm.

In addition, it is proposed that the hand power-tool device comprises an inhibiting device for inhibiting the operating element, having a release element that is provided to undo the inhibiting of the operating element, whereby particularly safe operation can be achieved, because the operating element can be inhibited against unintentional actuation, for transport and/or storage. An "inhibiting device" is to be understood to mean, in particular, a device that prevents at least a reaction to an actuating force acting upon the operating element, i.e. a force in an actuating direction. Advantageously, the inhibiting device prevents, in particular mechanically, an actuating movement of the operating element. Alternatively or additionally, the inhibiting device could interrupt an output of energy, in particular electrical energy, to a means that can be actuated by means of the operating element. For example, a switching unit could interrupt a supply of energy to the motor. Preferably, the release element differs haptically from the operating element and/or has advantageously differing actuating directions. An "actuating direction" is to be understood to mean, in particular, a direction in which the operating element is carried such that it can be moved from a non-actuated position into an actuated position.

Furthermore, it is proposed that the housing region encloses at least one free region, into which the operating element is carried such that it can be sunk, at least partially, upon an actuation, whereby, advantageously, the operating element can be operated and well protected. A "free region" is to be understood to mean, in particular, a region that is adjacent to the operating element and that, when the operating element is not actuated, is free of the operating element and, in particular, third elements. Preferably, the operating element can be actuated by being moved in the direction of the free region. In particular, "enclose" is to be understood to mean that the free region is disposed within the housing region, i.e. in particular, that the housing region encloses the free region, at least largely, on a hemisphere.

In an advantageous realization of the disclosure, it is proposed that the operating element, when in a non-actuated operating state, is disposed in an at least partially sunk manner in the housing region, such that the operating element is disposed in an advantageously protected manner. "Disposed in an at least partially sunk manner" is to be understood to mean, in particular, that at least 5%, advantageously at least 10% of a material of the operating element, when in a non-actuated operating state, is disposed within a face that spans a surface of the housing region, advantageously an inner face of the housing. Advantageously, at least one stop of the operating element is disposed in a sunk manner in the housing region, which stop prevents the operating element from moving completely out of the housing region. Preferably, the operating element protrudes from the housing region at a through-hole or, alternatively, at a plurality of through-holes.

In a further configuration, it is proposed that the bearing comprises at least one film hinge, with the result that little resource input is required for structural configuration and production costs are kept low. A "film hinge" is to be understood to mean, in particular, a hinge in which a flat, flexible material transmits a bearing force. Preferably, the film hinge is realized so as to be integral with the housing region and/or, advantageously, with the operating element.

Preferably, the film hinge has a flexurally soft region, which transmits substantially only tensile and/or compressive forces.

Furthermore, it is proposed that the bearing has at least one oblong hole, at least for guiding the operating element, thereby enabling the operating element to move, particularly advantageously, in a guided manner. An "oblong hole" is to be understood to mean, in particular, a blind hole and/or a through opening, having a non-round, preferably elongate outer form in relation to a surrounding face.

Further, it is proposed that the operating element has at least two operating faces carried so as to be movable relative to each other, enabling an advantageous symmetry of the operating element to be achieved. Preferably, the operating faces are carried so as to be tiltable by at least 10 degrees, preferably at least 20 degrees, in relation to each other.

In addition, the disclosure is based on a hand power tool having a hand power-tool device, it being the case that all hand power tools considered appropriate by persons skilled in the art, such as, in particular, drills, hammer drills, saws, planes, screwdrivers, routers, sanders, multifunction tools, garden appliances and/or, advantageously, angle grinders, would be conceivable, thereby making it possible to provide a hand power tool that is particularly comfortable to use.

BRIEF DESCRIPTION OF THE DRAWINGS

Further advantages are given by the following description of the drawing. The drawing shows five exemplary embodiments of the disclosure. The drawing and the description contain numerous features in combination. Persons skilled in the art will also expediently consider the features individually and combine them to create appropriate further combinations.

In the drawing.

DETAILED DESCRIPTION

Figure 1:
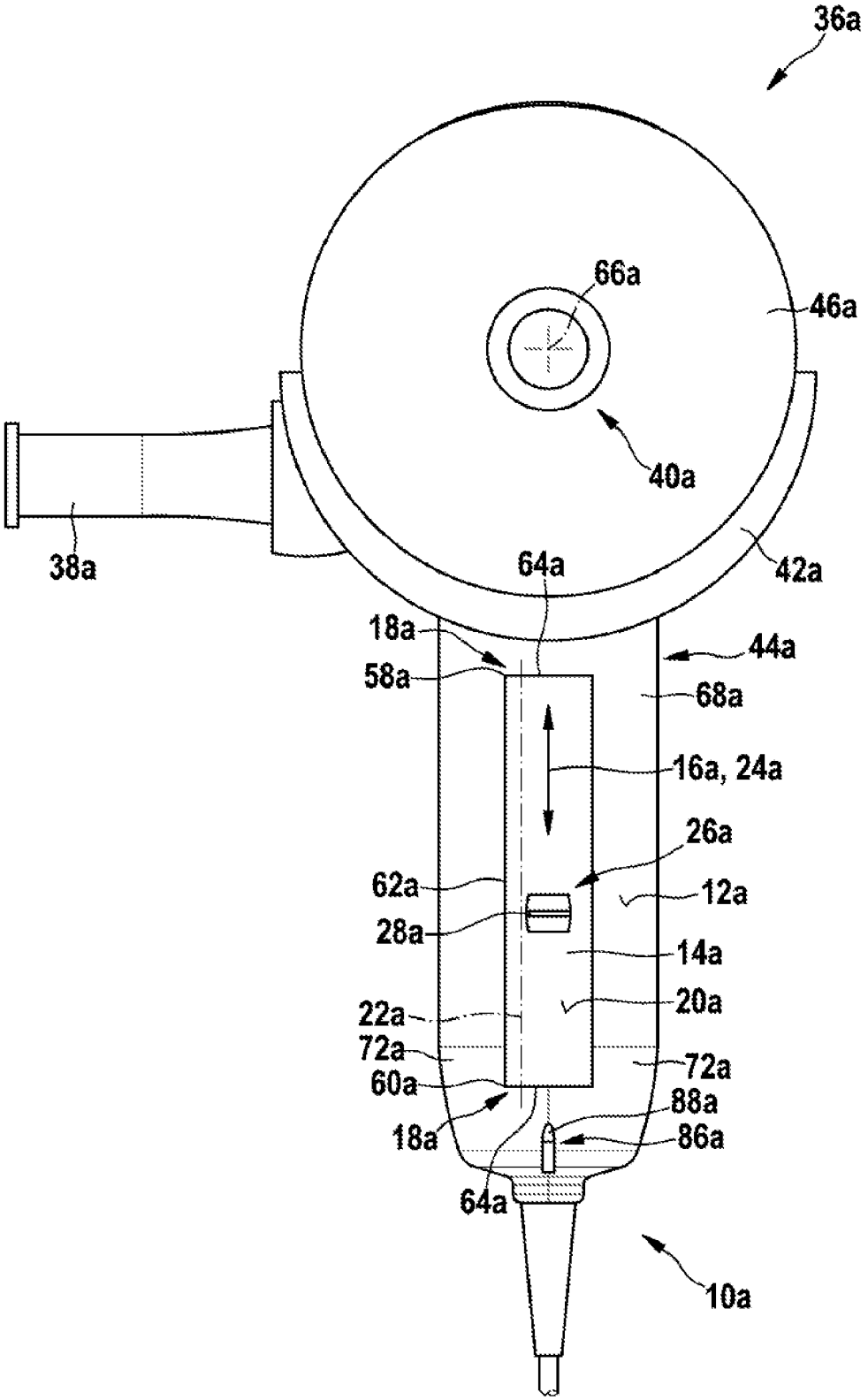
FIG. 1 shows a schematic representation of a hand power tool according to the disclosure, having a hand power-tool device, which comprises a rod-shaped housing region and an operating element.
Figure 2:
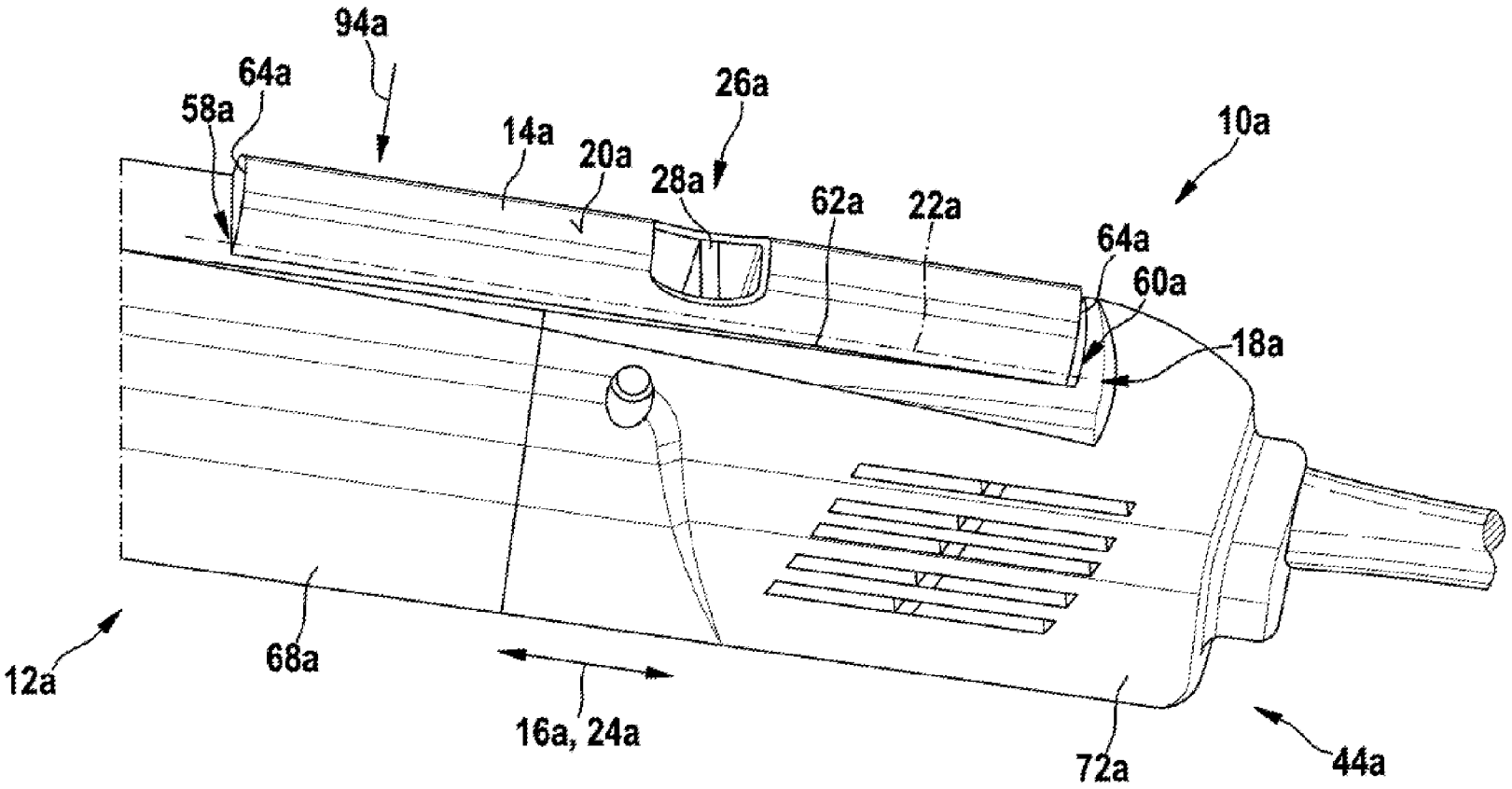
FIG. 2 shows a perspective representation of the housing region and the operating element from FIG. 1.

FIGS. 1 and 2 show a hand power tool 36a according to the disclosure having a hand power-tool device 10*a*. The hand power tool 36*a* is realized as an angle grinder. The hand power tool 36*a* has a weight of less than 3.5 kg, preferably less than 2.5 kg. It comprises a removable ancillary handle 38*a*, an insert-tool fastening 40*a*, an insert-tool guard 42*a* and a housing 44*a* . An insert tool 46*a* is fastened to the insert-tool fastening 40*a*.

The hand power tool device 10*a* has a housing region 12*a* constituted by a surface of the housing 44*a*. The housing region 12*a* is realized in the shape of a rod. During operation, it serves as a main handle element. For this purpose, the housing region 12*a* has a roundish cross section on a plane aligned perpendicularly in relation to a direction of main extent 16*a*. A direction of main extent of the ancillary handle 38*a* is aligned substantially perpendicularly in relation to the direction of main extent 16*a* of the housing region 12*a*. The insert-tool guard 42*a* is disposed between the insert-tool fastening 40*a* and the housing region 12*a*. It protects an operator's hand as it grips the housing region 12*a*.

In addition, the hand power-tool device 10*a* has an operating element 14*a*. The operating element 14*a* extends on the housing region 12*a*, along the direction of main extent 16*a* of the housing region 12*a*, extending on a side of the housing region 12*a* that faces toward the insert-tool fastening 40*a*. Alternatively, it could also be disposed on a side of the housing region 12*a* that faces away from the insert-tool fastening 40*a*, or on another side considered appropriate by persons skilled in the art. In particular, the housing region 12*a* could be rotatable relative to the insert-tool fastening 40*a*. The operating element 14*a* has a direction of main extent 24*a*, which is aligned parallelwise in relation to the direction of main extent 16*a* of the housing region 12*a*. The operating element 14*a* in this case extends over at least a greater part of a total length of the rod-shaped housing region 12*a*. The operating element 14*a* has an operating face 20*a* having a substantially rectangular projection face. The operating face 20*a* is realized so as to be convexly curved about a center axis of the housing region 12*a* that extends along the direction of main extent 16*a* of the housing region 12*a*. Disposed between the operating element 14*a* and the housing 44*a* there is a sealing lip, not represented in greater detail, or other overlapping element, by means of which the housing 44*a* is protected against the ingress of dirt. The sealing lip or the overlapping element is fastened to the housing 44*a*.

The hand power-tool device 10*a* has a bearing 18*a*, by which the operating face 20*a* of the operating element 14*a* is carried so as to be swivelable, relative to the housing region 12*a*, about an axis 22*a* aligned parallelwise in relation to the direction of main extent 16*a* of the housing region 12*a*. For this purpose, the housing region 12*a* comprises a free region 30*a*, into which the operating element 14*a* is carried such that it can be partially sunk upon an actuation. The hand power-tool device 10*a* comprises a spring element, not represented in greater detail, which effects a force upon the operating element 14*a*, which force is provided to swivel the operating element 14*a* out of the free region 30*a* upon termination of an actuation. When in a non-actuated operating state, the operating element 14*a* is disposed so as to be at least partially sunk in the housing region 12*a*, at least a stop 48*a* of the operating element 14*a* being disposed in a sunk manner. The stop 48*a* prevents the operating element 14*a* from being swiveled completely out of the housing region 12*a* by the spring element.

Figure 3:
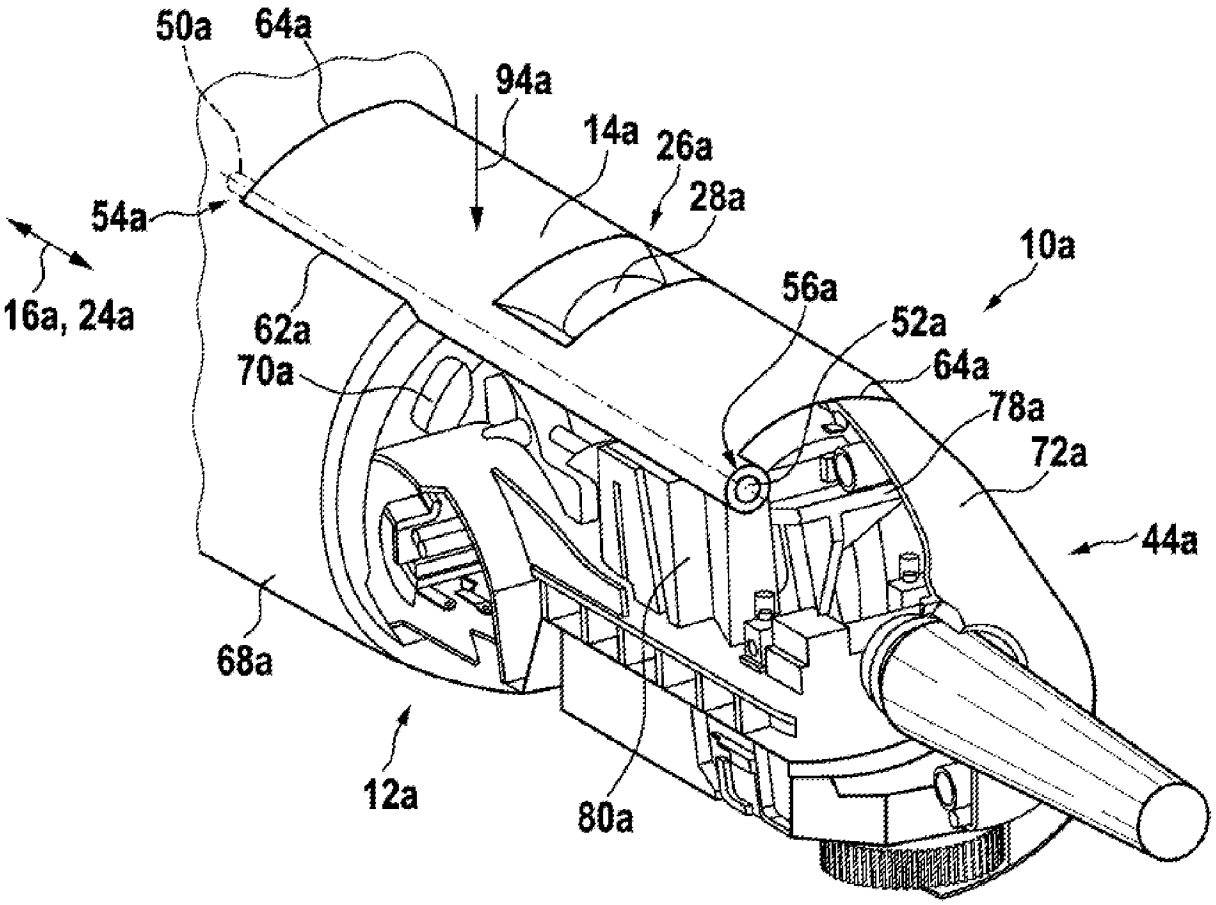
FIG. 3 shows a perspective representation of a portion of the housing region and the operating element from FIG. 1.
Figure 4:
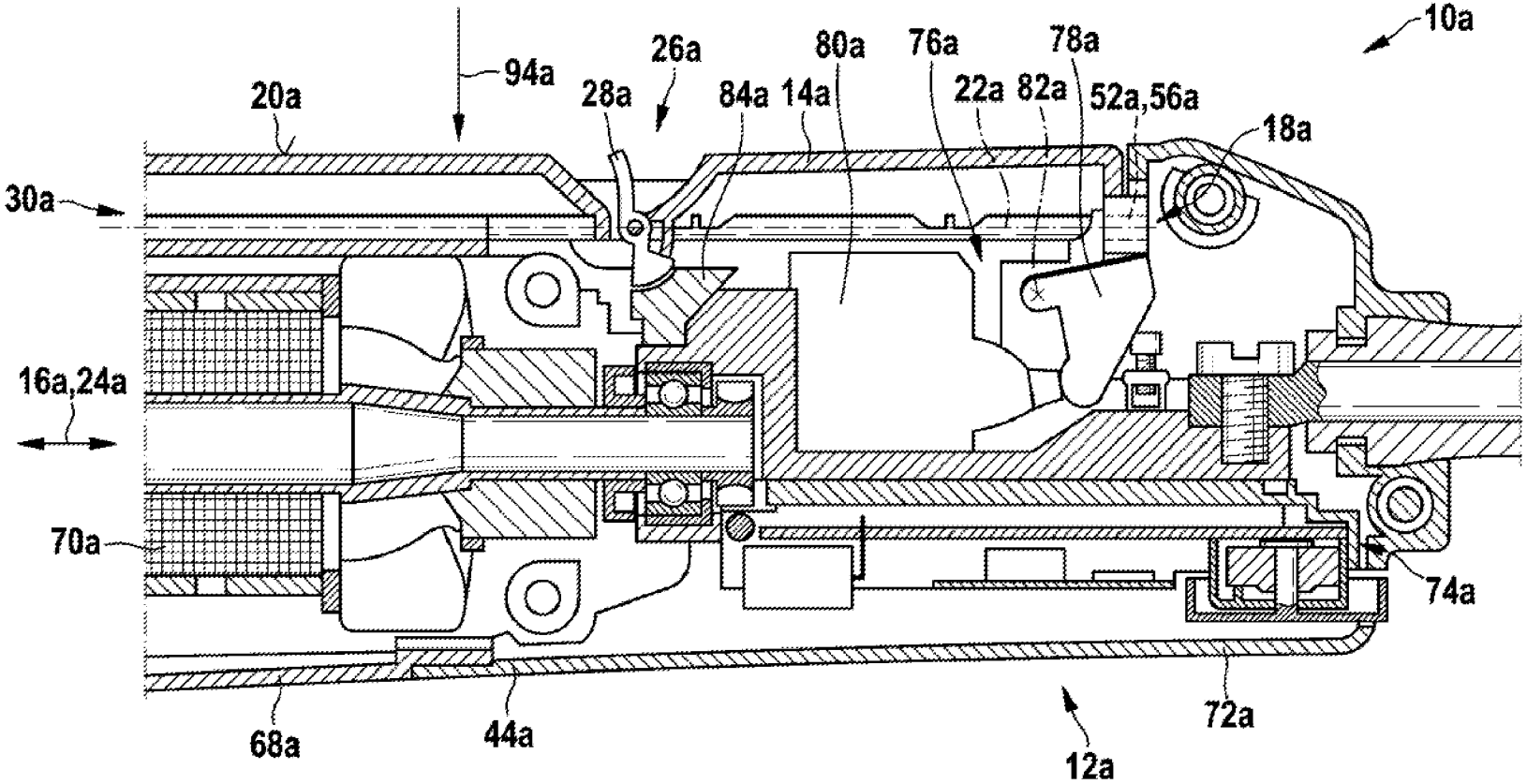
FIG. 4 shows a sectional representation of the housing region and the operating element from FIG. 1.
Figure 5:
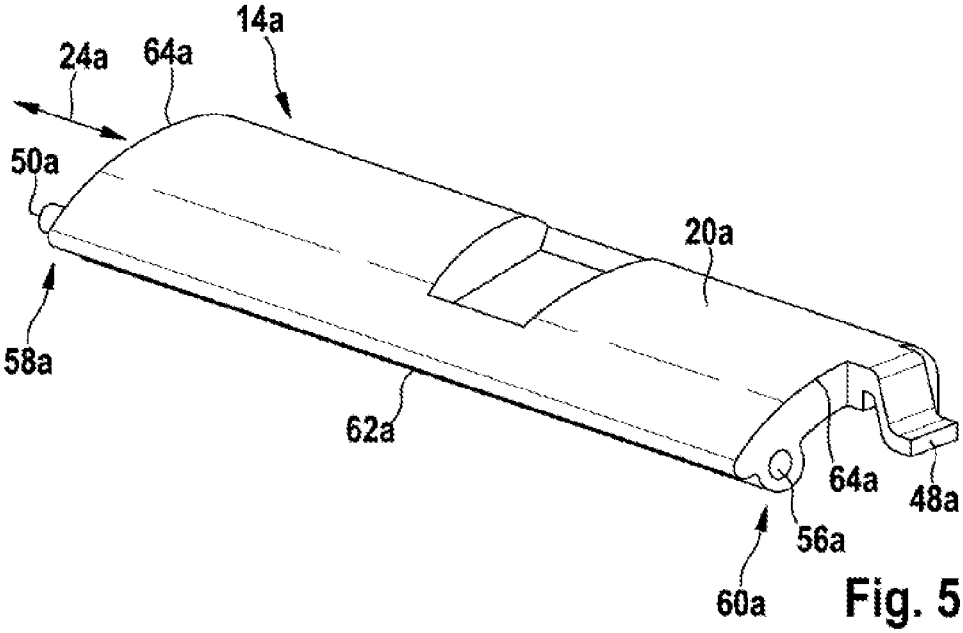
FIG. 5 shows a perspective detail representation of the operating element from FIG. 1.

As shown by FIGS. 3, 4 and 5, the bearing 18*a* comprises two studs 50*a*, 52*a* and two recesses 54*a*, 56*a*. One of the studs 50*a* is formed on to the operating element 14*a*, on a corner 58*a* of the operating element 14*a* that faces toward the insert-tool fastening 40*a*. The associated recess 54*a* is formed on to the housing 44*a*, on a side of the housing region 12*a* that faces toward the insert-tool fastening 40*a*. The other recess 56*a* is formed on to the operating element 14*a*, on a corner 60*a* of the operating element 14*a* that faces away from the insert-tool fastening 40*a*. The associated stud 52*a* is formed on to the housing 44*a*, on a side of the housing region 12*a* that faces away from the insert-tool fastening 40*a*. Alternatively, studs and/or recesses of the bearing 18*a* could be constituted by discrete units or materials; for example, a metallic stud, in particular a steel stud, could be pressed a recess in the housing 44*a* and/or in the operating element 14*a* and carried with rotational play in the respectively other component.

The corners 58*a*, 60*a* in this case are disposed between an edge 62*a* of the operating element 14*a* that is aligned parallelwise in relation to the direction of main extent 16*a* and, respectively, an edge 64*a* that is aligned perpendicularly in relation to the direction of main extent 16*a* and perpendicularly in relation to a rotational axis 66*a* of the insert-tool fastening 40*a*. The two corners 58*a*, 60*a* in this case are located on the same side of the operating element 14*a*, as viewed in the direction of main extent 16*a*, it being irrelevant for operation whether the corners 58*a*, 60*a* are disposed on the left or on the right. The axis 22*a* of the bearing 18*a* is thus disposed at a distance from a plane that is spanned by the rotational axis 66*a* of the insert-tool fastening 40*a* and the direction of main extent of the housing region 12*a*.

During assembly, the operating element 14*a* is fastened by a fastening directed on to the insert-tool fastening 40*a*. In this case, one of the studs 50*a*, 52*a* penetrates, respectively, into one of the recesses 54*a*, 56*a*. The axis 22*a* of the bearing 18*a* extends through the two studs 50*a*, 52*a*. In addition, the bearing 18*a* could have further bearing elements, in particular between the studs 50*a*, 52*a*, and the recesses 54*a*, 56*a*. Alternative arrangements of the studs and recesses that are considered appropriate by persons skilled in the art are possible. Further, a film hinge between the operating element 14*a* and the housing 44*a* would be possible.

The housing 44*a* has a housing element 68*a*, which fastens a motor 70*a* of the hand power tool 36*a*. In addition, the housing 44*a* has a housing element 72*a*, which fastens an electronics unit 74*a* of the hand power tool 36*a*. This housing element 72*a* is realized as two shells. One shell thereof is represented in FIG. 3. The housing element 68*a* that fastens the motor 70*a* has one of the studs 52*a* and one of the recesses 54*a*. This housing element 68*a* therefore carries the operating element 14*a*. The housing element 72*a* that fastens the electronics unit 74*a* prevents the operating element 14*a* from moving along the direction of main extent 16*a*, when in an assembled state. As a result, the studs 50*a*, 52*a* are held in the recesses 54*a*, 56*a*.

The hand power-tool device 10*a* has an actuation pickup 76*a*. Upon an actuation, the actuation pickup 76*a* generates an electrical characteristic quantity, which contains at least information relating to the actuation. It comprises the spring element, not represented in greater detail, a lever 78*a* and an electrical switching component 80*a*. The lever 78*a* is carried so as to be movable about an axis 82*a* and, upon an actuation, converts a movement of the operating element 12*a* in a manner suitable for the switching component 80*a*.

Figure 6:
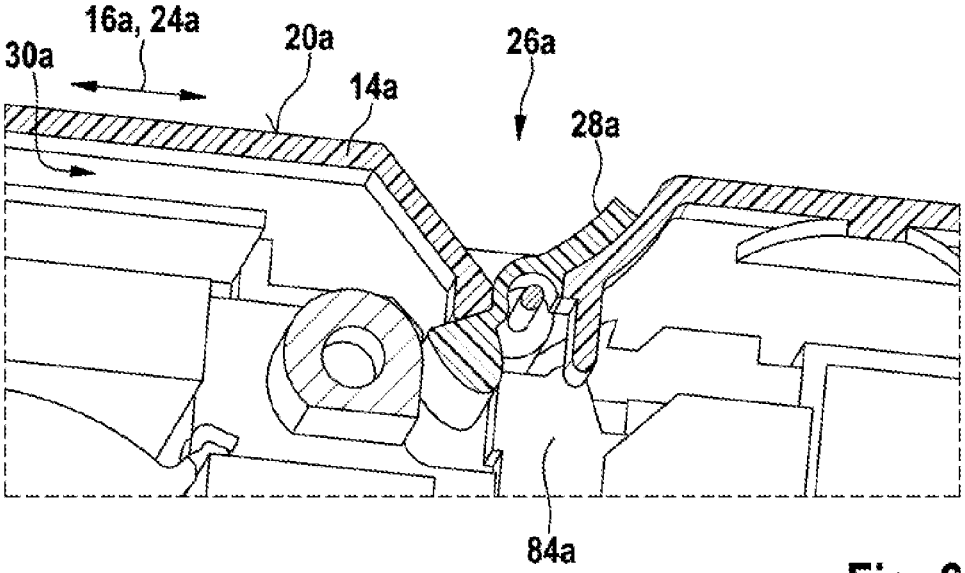
FIG. 6 shows a perspective sectional representation of an inhibiting device of the hand power-tool device from FIG. 1.

The hand power-tool device 10*a* has an inhibiting device 26*a*, which is represented in greater detail in FIGS. 4 and 6. FIG. 4 shows the the operating element 14*a* in a non-actuated state and the inhibiting device 26*a* in an inhibiting state. FIG. 6 shows the operating element 14*a* in an actuated state and the inhibiting device 26*a* in a non-inhibiting state. The inhibiting device 26*a* has a release element 28*a* and a stop 84*a*. The release element 28*a* is carried, on the operating element 14*a*, so as to be swivelable. It is disposed centrally on the operating element 14*a*. The stop 84*a* is formed on to the housing 44*a*. When the release element 28*a* is in an inhibiting configuration, the release element 28*a* supports on the housing 44*a* an actuating force acting upon the operating element 14*a*.

Figure 7:
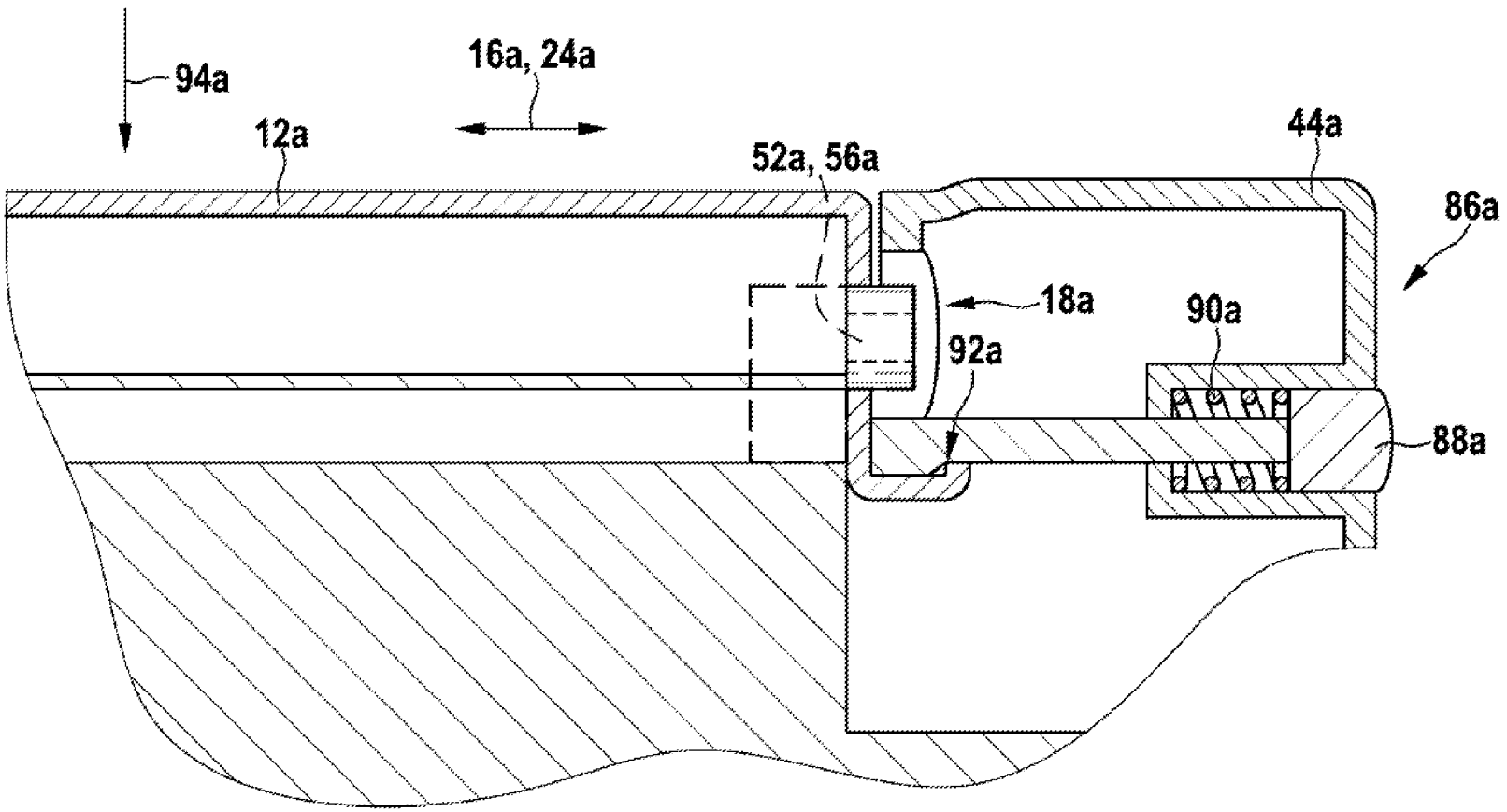
FIG. 7 shows a sectional representation of a locking device of the hand power tool from FIG. 1.

The hand power-tool device 10*a* comprises a switch-on locking mechanism 86*a*, represented only in FIGS. 1 and 7. The switch-on locking mechanism 86*a* has an operating means 88*a*, a spring element 90*a* and a latching means 92*a*. The operating means 88*a* is carried so as to be movable perpendicularly in relation to an actuating direction 94*a* of the operating element 14*a*. The spring element 90*a* effects a restoring force upon the operating means 88*a*. When the operator has actuated the operating element 14*a*, he can move the operating means 88*a*, against the spring element 90*a*, into a latching position represented in FIG. 7. In the latching position, the operating means 88*a* latches into the operating element 14*a*, by means of the latching means 92*a*. When in a latched-in state, the switch-on locking mechanism 86*a* prevents the operating element 14*a* from moving back into a non-actuated initial position, even if the operator does not exert any actuating force upon the operating element 14*a*. If the operator moves the operating element 14*a*, in a latched-in state, in the actuating direction 94*a*, the latching of the latching means 92*a* opens and the spring element 90*a* moves the operating means 88*a* into a non-locking position, not represented in greater detail.

During a parting operation, the operator holds the housing region 12*a*, advantageously by gripping with the left or the right hand, along the direction of main extent 16*a*, in a central region, or in a front region facing toward the insert-tool fastening 40*a*. The operator in this case uses either the ball of the hand or the thumb to actuate the operating element 14*a*. During overhead working, the operator advantageously holds the housing region 12*a* at a rear region that faces away from the insert-tool fastening 40*a*. During surface working, i.e. when the insert tool 46*a* is aligned approximately parallelwise in relation to a surface that is to be worked, the operator advantageously uses the tip of the finger opposite the thumb to actuate the operating element 14*a*.

Four further exemplary embodiments of the disclosure are shown in FIGS. 8 to 13. The following descriptions and the drawings are limited substantially to the differences between the exemplary embodiments and, in respect of components having the same designation, in particular in respect of components having the same references, in principle reference may also be made to the drawings and/or the description of the other exemplary embodiments, in particular of FIGS. 1 to 7. In order to differentiate the exemplary embodiments, the letter a has been appended to the references of the exemplary embodiment in FIGS. 1 to 7. In the exemplary embodiments of FIGS. 8 to 13, the letter a has been replaced by the letters b to e.

Figure 8:
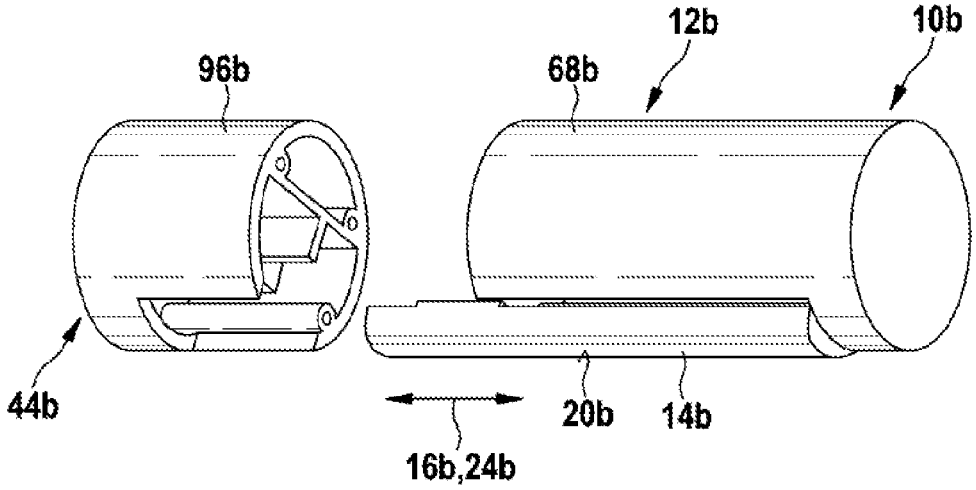
FIG. 8 shows a perspective representation of a second exemplary embodiment of the hand power-tool device from FIG. 1.
Figure 9:
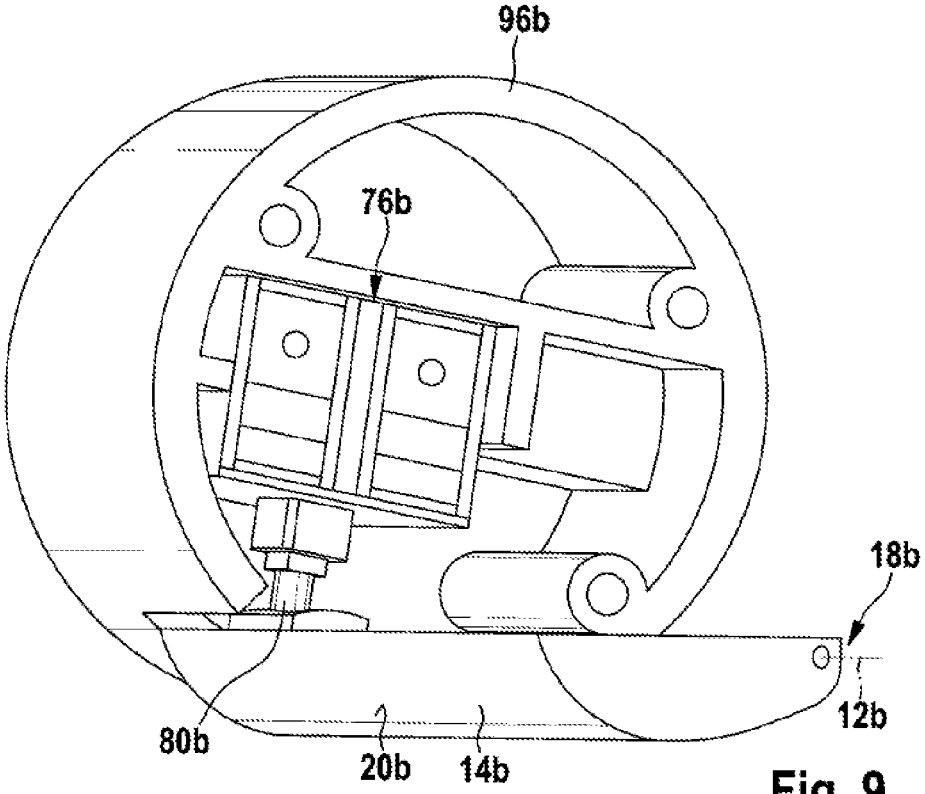
FIG. 9 shows a perspective representation of a portion of a housing region, an operating element and an actuation pickup of the hand power-tool device from FIG. 8.

FIGS. 8 and 9 show a hand power-tool device 10*b* having an operating element 14*b* and a housing 44*b*. The housing 44*b* constitutes a rod-shaped housing region 12*b*, which, during operation, serves as a main handle element. The housing 44*b* has a pot-shaped housing cover 96*b*, and has a housing element 68*b* provided to fasten a motor, not represented in greater detail. The housing 44*b* fastens the operating element 14*b*. The operating element 14*b* extends, on the housing region 12*b*, along a direction of main extent 16*b* of the housing region 12*b*. In addition, the hand power-tool device 10*b* has a bearing 18*b*. The bearing 18*b* carries an operating face 20*b* of the operating element 14*b* so that it can swivel about an axis 22*b* aligned parallelwise in relation to the direction of main extent 16*b*. As an alternative to the pot-shaped housing cover 96*b*, the operating element 14*b* could also be carried in a housing element, not represented in greater detail, provided to fasten a transmission.

The hand power-tool device 10*b* comprises an actuation pickup 76*b* having a switching component 80*b*. The actuation pickup 76*b* is provided to directly actuate the switching component 80*b* upon a movement of the operating element 14*b* in the actuating direction 94*b*.

Figure 10:
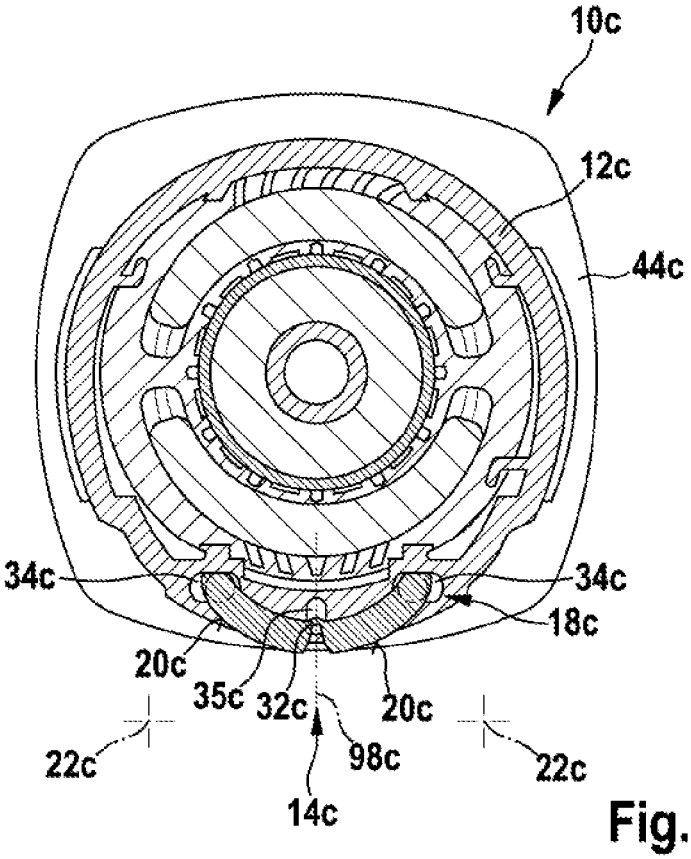
FIG. 10 shows a sectional representation of a third exemplary embodiment of the hand power-tool device from FIG. 1.
Figure 11:
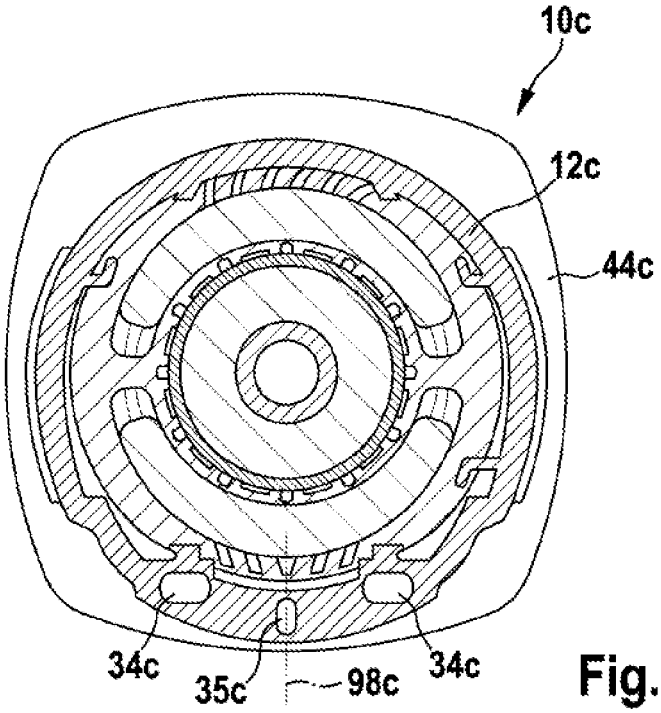
FIG. 11 shows a sectional representation of a portion of a housing region and a motor of the hand power-tool device from FIG. 10.

FIGS. 10 and 11 show a partial section of a hand power-tool device 10*c* of a hand power tool having a rod-shaped housing region 12*c*, an operating element 14*c* and a bearing 18*c*. During operation, the housing region 12*c* serves as a main handle element. The operating element 14*c* extends, on the housing region 12*c*, along a direction of main extent 16*c* of the housing region 12*c*. It has two operating faces 20*c*. The bearing 18*c* carries the operating face 20*c* of the operating element 14*c* so that it can be swiveled and in addition tilted, respectively, about an axis 22*c* aligned parallelwise in relation to the direction of main extent 16*c*. The axes 22*c* are disposed at a distance from the hand power-tool device 10*c*.

The bearing 18*c* has oblong holes 34*c*, 35*c* for the purpose of guiding the operating element 14*c*. The oblong holes 34*c*, 35*c* are disposed on a housing 44*c* of the hand power tool, being disposed on two sides of a free region 30*c* of the housing 44*c*, a represented side facing toward an insert-tool fastening of the hand power tool, and a non-represented side facing away from the insert-tool fastening. Two of the represented oblong holes 34*c* are disposed in a mirror-symmetrical manner in relation to a symmetry plane 98*c* that extends through the third oblong hole 35*c* represented. These two oblong holes 34*c* guide, respectively, one of the two operating faces 20*c* substantially perpendicularly in relation to the symmetry plane 98*c*. The third oblong hole guides both operating faces 20*c* equally in a direction parallel to the symmetry plane 98*c*. The bearing has a film hinge 32*c*, which carries the two operating faces 20*c* of the operating element 14*c* movably in relation to each other. It is possible to have between the operating faces 20*c* an alternatively realized bearing, considered appropriate by persons skilled in the art.

FIG. 11 shows a further exemplary embodiment of a switch-on locking mechanism 86*d* of a hand power-tool device 10*d* having an operating element 14*d*. The switch-on locking mechanism 86*d* has an operating means 88*d*, a spring element 90*d* and a latching means 92*d*. The operating means 88*d* is carried so as to be movable about an axis 100*d*, which is aligned perpendicularly in relation to the axis 22*d* of the operating element 14*d*. The spring element 90*d* effects a restoring force upon the operating means 88*d*. When the operator has actuated the operating element 14*d*, he can move the operating means 88*d* of the switch-on locking mechanism 86*d*, against the spring element 90*d*, into a latching position.

Figure 12:
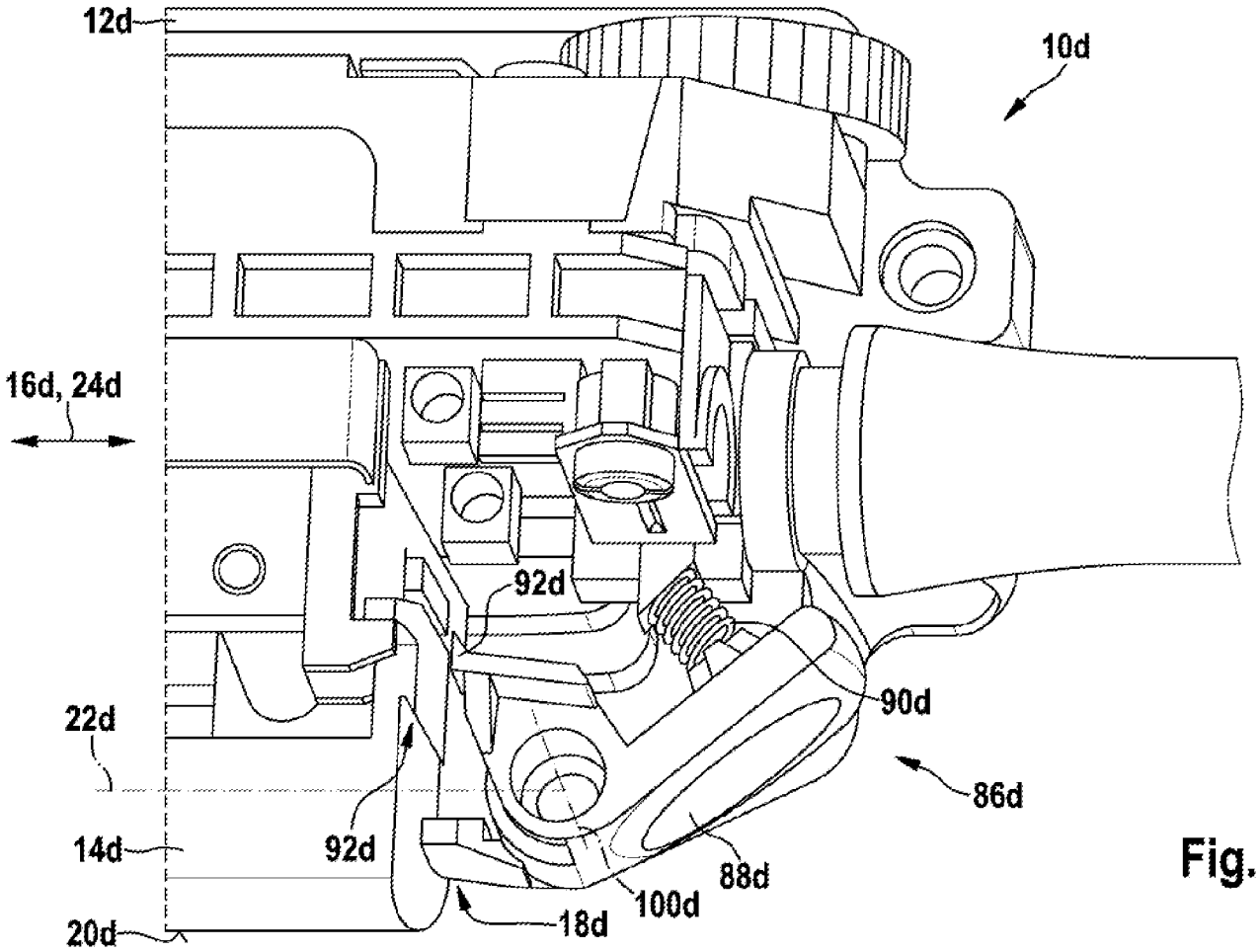
FIG. 12 shows a perspective representation of a further exemplary embodiment of the locking device from FIG. 7.

FIG. 12 shows a further exemplary embodiment of a hand power-tool device 10*e*, having an operating element 14*e*, which has two operating faces 20*e* that are carried movably in relation to each other. The two operating faces 20*e* are mounted such that they can be swiveled, respectively, about an axis 22*e*. One of the operating faces 20*e* has an opening 102*e*, into which a portion of another of the operating faces 20*e* can be sunk upon an actuation of the operating element 14*e*.

Figure 13:
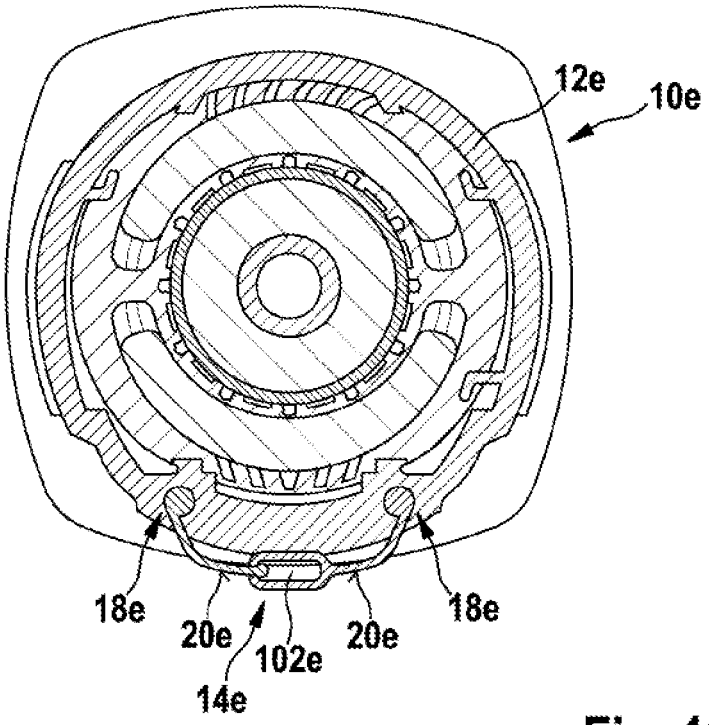
FIG. 13 shows a sectional representation of a fourth exemplary embodiment of the hand power-tool device from FIG. 1.
Figure 14:
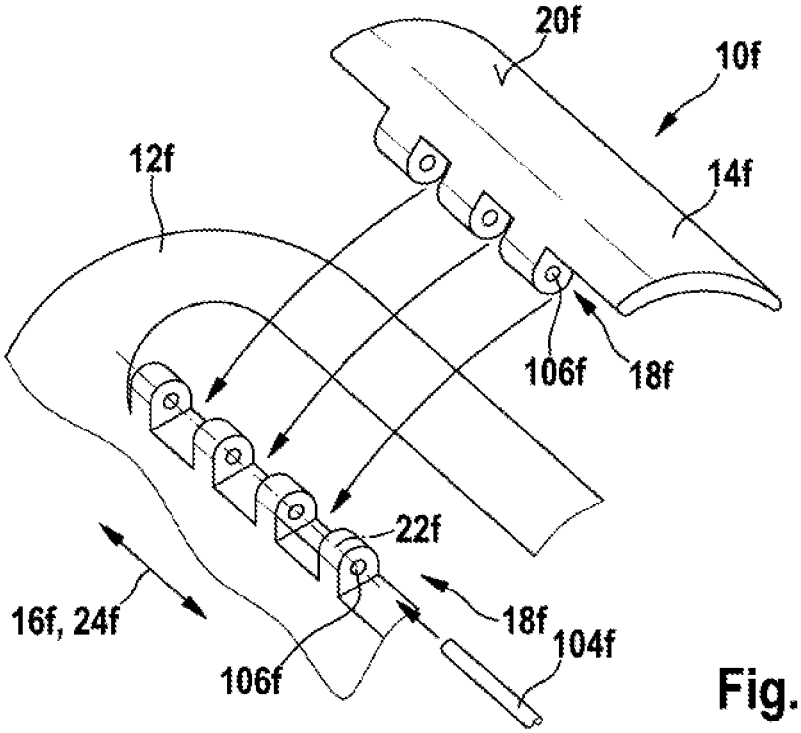
FIG. 14 shows a schematic, perspective representation of a fifth exemplary embodiment of the hand power-tool device from FIG. 1.

FIG. 13, in an exploded representation, shows a further exemplary embodiment of a hand power-tool device 10*f*, having a rod-shaped housing region 12*f*, an operating element 14*f* and a bearing 18*f*. The bearing 18*f* has a rod 104*f*, which extends along an axis 22*f* of the bearing 18*f*. The housing region 12*f* and the operating element 14*f* have openings 106*f*, through which the rod 104*f* extends when in an assembled operating state. The rod 104*f* in this case carries the operating element 14*f* such that it can be swiveled relative to the housing region 12*f*.

The invention claimed is:

1. A hand power-tool comprising:

a hand power-tool device including:

an at least substantially rod-shaped housing region configured to serve as a main handle element during operation of the device;

at least one operating element configured to extend on the housing region along a direction of main extent of the housing region;

at least one bearing configured to carry at least one operating face of the at least one operating element such that the at least one operating element is swivelable about at least one axis aligned at least substantially parallel to the direction of main extent of the housing region; and a motor enclosed in the housing region such that actuation of the at least one operating element operates the motor of the hand power-tool, wherein the at least one operating element has at least two operating faces configured to be carried so as to be movable relative to each other.

2. The hand power-tool device as claimed in claim 1, wherein the at least one operating element has a direction of main extent aligned at least substantially parallel to the direction of main extent of the housing region.

3. The hand power-tool device as claimed in claim 1, wherein the at least one operating element is configured to extend over at least half of a total length of the housing region.

4. The hand power-tool device as claimed in claim 1, wherein the at least one operating face is convexly curved.

5. The hand power-tool device as claimed in claim 1, further comprising:

an inhibiting device configured to inhibit the at least one operating element, the inhibiting device having a release element configured to uninhibit the at least one operating element.

6. The hand power-tool device as claimed in claim 5, wherein the release element is pivotable about an axis arranged substantially perpendicularly to the direction of main extent of the housing region.

7. The hand power-tool device as claimed in claim 1, wherein:

the housing region is configured to enclose at least one free region, and the at least one operating element is configured to be carried into the at least one free region so as to be sunk, at least partially, upon an actuation.

8. The hand power-tool device as claimed in claim 1, wherein the at least one operating element, when in a non-actuated operating state, is configured to be disposed in an at least partially sunk manner in the housing region.

9. The hand power-tool device as claimed in claim 1, wherein the at least one bearing includes at least one film hinge.

10. The hand power-tool device as claimed in claim 1, wherein the at least one bearing has at least one oblong hole configured at least to guide the at least one operating element.

11. A hand power-tool device comprising:

an at least substantially rod-shaped housing region configured to serve as a main handle element during operation of the device;

at least one operating element configured to extend on the housing region along a direction of main extent of the housing region;

at least one bearing configured to carry at least one operating face of the at least one operating element such that the at least one operating element is swivelable about at least one axis aligned at least substantially parallel to the direction of main extent of the housing region; and a release element pivotably supported by the at least one operating element and pivotable with respect to the at least one operating element between a first position, wherein the release element inhibits movement of the at least one operating element, and a second position, wherein the release element does not inhibit movement of the at least one operating element.

12. The hand power-tool device as claimed in claim 11, wherein the release element is pivotable about an axis arranged substantially perpendicularly to the direction of main extent of the housing region.

13. A hand power-tool comprising:

a hand power-tool device including:

an at least substantially rod-shaped housing region configured to serve as a main handle element during operation of the device;

at least one operating element configured to extend on the housing region along a direction of main extent of the housing region;

at least one bearing configured to carry at least one operating face of the at least one operating element such that the at least one operating element is swivelable about at least one axis aligned at least substantially parallel to the direction of main extent of the housing region;

a motor enclosed in the housing region such that actuation of the at least one operating element operates the motor of the hand power-tool; and an inhibiting device configured to inhibit the at least one operating element, the inhibiting device having a release element configured to uninhibit the at least one operating element, wherein the release element is pivotable about an axis arranged substantially perpendicularly to the direction of main extent of the housing region.

* * * * *